US006557387B2

(12) United States Patent
Kachouh

(10) Patent No.: US 6,557,387 B2
(45) Date of Patent: May 6, 2003

(54) ELECTRIC MOTOR ACTUATOR FOR A MOTOR VEHICLE LOCK

(75) Inventor: Checrallah Kachouh, Dortmund (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/749,643

(22) Filed: Dec. 28, 2000

(65) Prior Publication Data

US 2001/0050511 A1 Dec. 13, 2001

(30) Foreign Application Priority Data

Dec. 31, 1999 (DE) ..... 199 63 911
Jan. 22, 2000 (DE) ..... 100 02 776

(51) Int. Cl.[7] ..... E05B 47/00
(52) U.S. Cl. ..... 70/279.1; 70/264; 292/DIG. 23
(58) Field of Search ..... 70/264, 279.1; 292/201, 216, DIG. 23

(56) References Cited

U.S. PATENT DOCUMENTS 5,409,277 A * 4/1995 Rogers et al. ..... 292/201
5,419,597 A * 5/1995 Brackmann et al. ..... 292/201
5,441,317 A * 8/1995 Gruden et al. ..... 292/144
5,453,671 A 9/1995 Baier et al.
5,564,308 A * 10/1996 Hoshikawa et al. ..... 292/201
5,615,564 A * 4/1997 Inoue ..... 292/144
5,667,263 A * 9/1997 Kleefeldt et al. ..... 292/201
5,676,003 A * 10/1997 Ursel et al. ..... 292/201
5,833,282 A * 11/1998 Ikeda ..... 292/144
5,921,595 A * 7/1999 Brackmann et al. ..... 292/201
5,941,107 A * 8/1999 Hsu ..... 70/278.3
5,961,163 A * 10/1999 Brackmann et al. ..... 292/201
5,997,055 A * 12/1999 Strathmann ..... 292/199
6,050,117 A * 4/2000 Weyerstall ..... 292/201
6,145,354 A * 11/2000 Kondo et al. ..... 292/201

FOREIGN PATENT DOCUMENTS

| | | | |
|---|---|---|---|
| DE | 33 19 354 | | 12/1983 |
| DE | 3933432 | A1 * | 5/1990 |
| DE | 41 25 448 | A1 | 2/1993 |
| DE | 44 33 994 | | 3/1996 |
| DE | 44 33 994 | C1 | 3/1996 |
| DE | 195 33 199 | C1 | 3/1997 |
| DE | 195 36 611 | A1 | 4/1997 |
| DE | 198 14 002 | C2 | 10/1999 |
| GB | 2 335 947 | A | 10/1999 |

* cited by examiner

*Primary Examiner*—Anthony Knight
*Assistant Examiner*—Michael J. Kyle
(74) *Attorney, Agent, or Firm*—Nixon Peabody LLP; David S. Safran

(57) ABSTRACT

An electric motor actuator for a motor vehicle lock, with a reversible drive motor, an actuator drive which can be rotary driven by the drive motor. The actuator further includes an operating lever which is dynamically coupled to the actuator drive for switching the lock into an "unlocked" and "locked" operating state, an antitheft lever which is spring-loaded with a pretensioning spring and which is dynamically coupled to the actuator drive for holding the operating lever in the "locked" operating state. An emergency actuating element is used for manually engaging an antitheft lever into an "antitheft off" operating state to overcome a catch element on the actuator drive. The antitheft lever can be switched out of the "antitheft off" operating state into an "antitheft" operating state through a pretensioning spring on the antitheft lever such that the antitheft lever is held in the "antitheft off" operating state by a control crank on the actuator drive, and is held in the "unlocked" operating state by the operating lever.

17 Claims, 6 Drawing Sheets

ELECTRIC MOTOR ACTUATOR FOR A MOTOR VEHICLE LOCK

BACKGROUND OF THE INVENTION

1. Field of the Invention

The present invention pertains generally to an electric motor actuator for a motor vehicle lock for a side door lock, rear door lock, hood lock or the like. More specifically, the present invention is directed to an electric motor actuator for a motor vehicle lock and includes a reversible drive motor and an actuator drive which can be rotary driven by the drive motor. The electric motor actuator further includes an operating lever which is dynamically coupled to the actuator drive for switching the lock into an "unlocked" and "locked" operating state, an antitheft lever which is spring-loaded with a pretensioning spring and which is dynamically coupled to the actuator drive for holding the operating lever in the "locked" operating state. An emergency actuating element is used for manually engaging an antitheft lever into an "antitheft off" operating state to overcome a catch element on the actuator drive. The antitheft lever can be switched out of the "antitheft off" operating state into an "antitheft" operating state through a pretensioning spring on the antitheft lever such that the antitheft lever is held in the "antitheft off" operating state by a control crank on the actuator drive, and is held in the "unlocked" operating state by the operating lever.

2. Description of the Related Art

German Patent DE 44 33 994 C1 discloses a conventional electric motor actuator for a motor vehicle lock including an actuator element comprising an actuator disk which is driven clockwise and counterclockwise by an electric drive motor, and therefore can be reversibly driven. Other prior art devices of the type mentioned above are disclosed in German Patent DE 33 19 354 C2, U.S. Pat. No. 5,409,277, and Published German Application DE 198 27 751 A1.

These prior art devices, however, fail to disclose a more detailed configuration of a combination including a drive motor and an actuator disk. An electric motor actuator having an actuator disk as the actuator element has proven to be compact and reliable. In one such motor vehicle lock, an actuator disk is regularly used with an actuating lever system and a locking lever system. Generally, the actuating lever system has an outer actuating lever and an inner actuating lever whereby the outer actuating lever is connected to an outside door handle, while the inner actuating lever is connected to an inner door handle. The locking lever system generally has at least one inner locking lever that is either made separately, for example, leading to an inside locking button, or can also be integrated with the inner actuating lever. On the front side doors of a motor vehicle and on the rear door of a station wagon there is also an outer locking lever which is connected to a lock cylinder and/or a remote control means.

The use of a "locked-antitheft" operating state means that the motor vehicle lock cannot be opened by undue application of force to the inner locking lever and/or the inner actuating lever. This unallowable application of force is possible after breaking a window, but should remain ineffective in the "locked-antitheft" operating state. The locking lever system of the motor vehicle lock is switched back and forth by means of the electric motor actuator between the operating states "unlocked", "locked", and "locked-antitheft". The operating lever of the actuator can be manually switched back and forth between the "unlocked" and "locked" operating states. If, however, the actuator is in the "locked-antitheft" operating state, the operating lever is blocked in the "locked" operating state by way of the antitheft lever. If the electric drive motor fails in this operating position, actuation must be produced by way of a mechanical emergency actuating element which engages the antitheft lever, especially a key-actuated outer locking lever of the locking lever system. The antitheft lever with the actuator disk remains unchanged and can be mechanically/manually set back into the "antitheft-off" operating state. In this state, the operating lever is released, and can be mechanically/manually switched from the "locked" operating state into the "unlocked" operating state by actuating the inner locking lever and/or the inner actuating lever.

In the prior art devices, an emergency actuation function is implemented in that the antitheft lever is pretensioned in the "antitheft off" operating state by a pretensioning spring or the like, and can be moved by means of a driver projection on the actuator disk into the "antitheft" operating state if the operating lever at this time is in the "locked" operating state. In addition, driving by means of the actuator disk takes place via a catch which can be raised from the outer locking lever for emergency actuation. The antitheft lever then snaps back into the "antitheft off" operating state under the force of the pretensioning spring.

In such electric motor actuators, manual unlocking when the central interlock drive fails can be accomplished easily, reliably and promptly. The construction of the antitheft lever necessary for this purpose with pretensioning springs and a raisable catch is, however, relatively complex in terms of mechanical construction. In addition, when the spring of the pretensioning spring for the antitheft lever breaks, emergency mechanical actuation is no longer possible. The arrangement of the actuator disk, the operating lever and the raisable catch in the above-explained electric motor actuator is such that the catch in the "antitheft" operating state must accommodate very high forces under certain circumstances. This high application of force to the catch can only be structurally accomplished with difficulty. Only with very high quality materials which are then correspondingly expensive can this be done. Kinematically, this arrangement has a defect in that the directions of rotation of the actuator disk are not unequivocal for throwing over the operating lever.

Based upon the design having a catch and pretensioning spring on the antitheft lever, it is necessary that the operating lever is thrown over once clockwise, another time counterclockwise into the same operating state, therefore, into a "locked" or "unlocked" operating state. Which direction of rotation is actually necessary is then determined by the respective position of the catch. Therefore a very intelligent, efficient electronic control is necessary; this again results in major costs.

SUMMARY OF THE INVENTION

Accordingly, it is an object of the present invention to overcome the aforementioned disadvantages in improving the design of the conventional electric motor actuator of the initially mentioned type with consideration of the requirements for emergency mechanical actuation.

This object is achieved in an electric motor actuator for a motor vehicle lock having an antitheft lever that is automatically controlled by an actuator drive, and thus not in conjunction with an operating lever. Control of the antitheft lever takes place such that the antitheft lever is pretensioned by means of a pretensioning spring or the like in the direction of an "antitheft" operating state, and therefore, can be switched from an "antitheft off" operating state into an "antitheft" operating state. If the pretensioning spring breaks, the antitheft lever remains either in the "antitheft off" operating state or can be manually/mechanically switched into an operating state by means of an emergency actuation mechanism. Moreover, an additional catch is not employed since the antitheft lever can be held by a control crank on the actuator drive or disk in the "antitheft off" operating state.

Other advantages are provided due to the elimination of an addition catch, and thereby an additional spring mechanism. In addition, control of the electric motor actuator can be made simple due to the overall construction causes the actuator disk to unambiguously activate the operating lever. Consequently, a single direction of rotation of the actuator disk is always assigned to the displacement of the operating lever into the same operating state. In accordance with an aspect of the present invention, it is, however, advantageous that the desired manner of operation of the actuator be preserved and nevertheless the antitheft function has been integrated into the actuator itself.

Another advantage of the electric motor actuator in accordance to the present invention is also its compact structure which can be especially facilitated by the actuator disk or the like being made in three planes, specifically a middle plane for coupling the actuator disk to the electric drive motor, a lower plane for coupling the actuator disk to the operating lever, and an upper plane for coupling the actuator disk to the antitheft lever. The terms "lower" and "upper" are interchangeable and in this case according to the preferred teaching are defined such that "lower" means the position nearest the bottom of the housing and "upper" means the position farthest from the housing bottom.

The present invention will be better understood by those skilled in the art and the above objects will become more apparent in the following detailed description of the preferred embodiment of the invention.

DETAILED DESCRIPTION OF THE DRAWINGS

DETAILED DESCRIPTION OF THE PREFERRED EMBODIMENT

Figure 1:
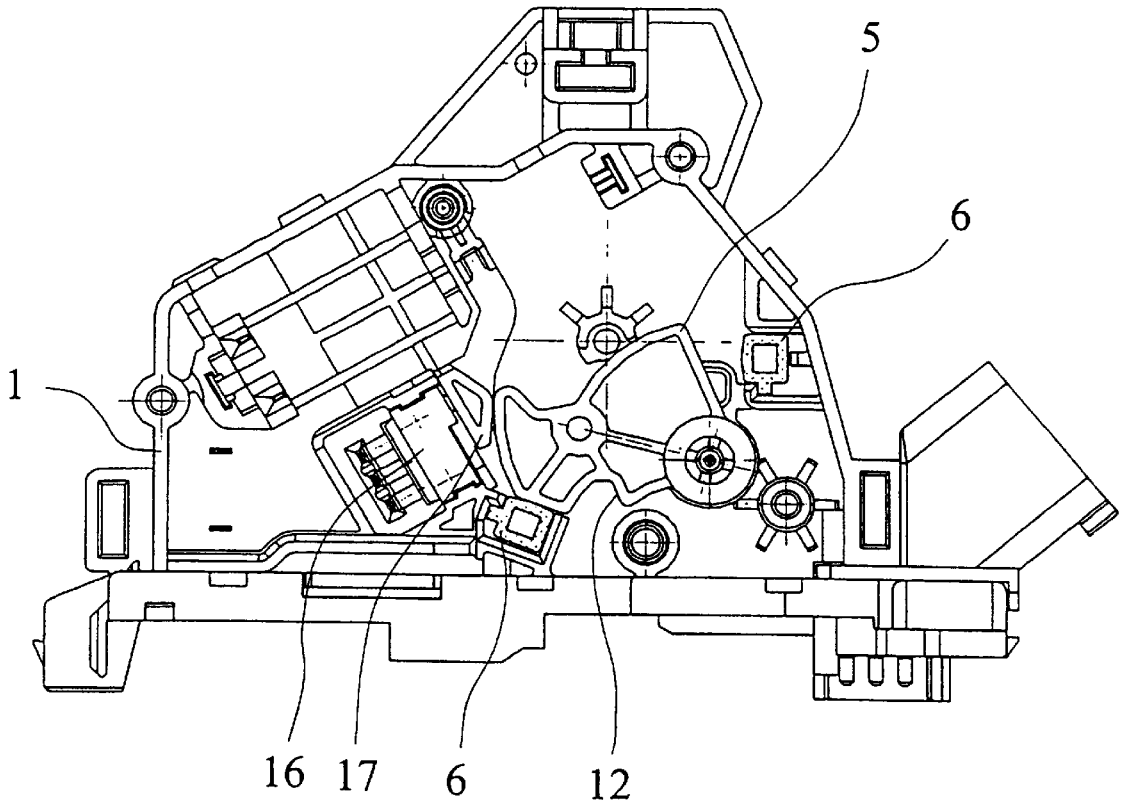
FIG. 1 shows a preferred embodiment of an electric motor actuator for a motor vehicle lock in the "lower" plane and "unlocked" operating state.
Figure 2:
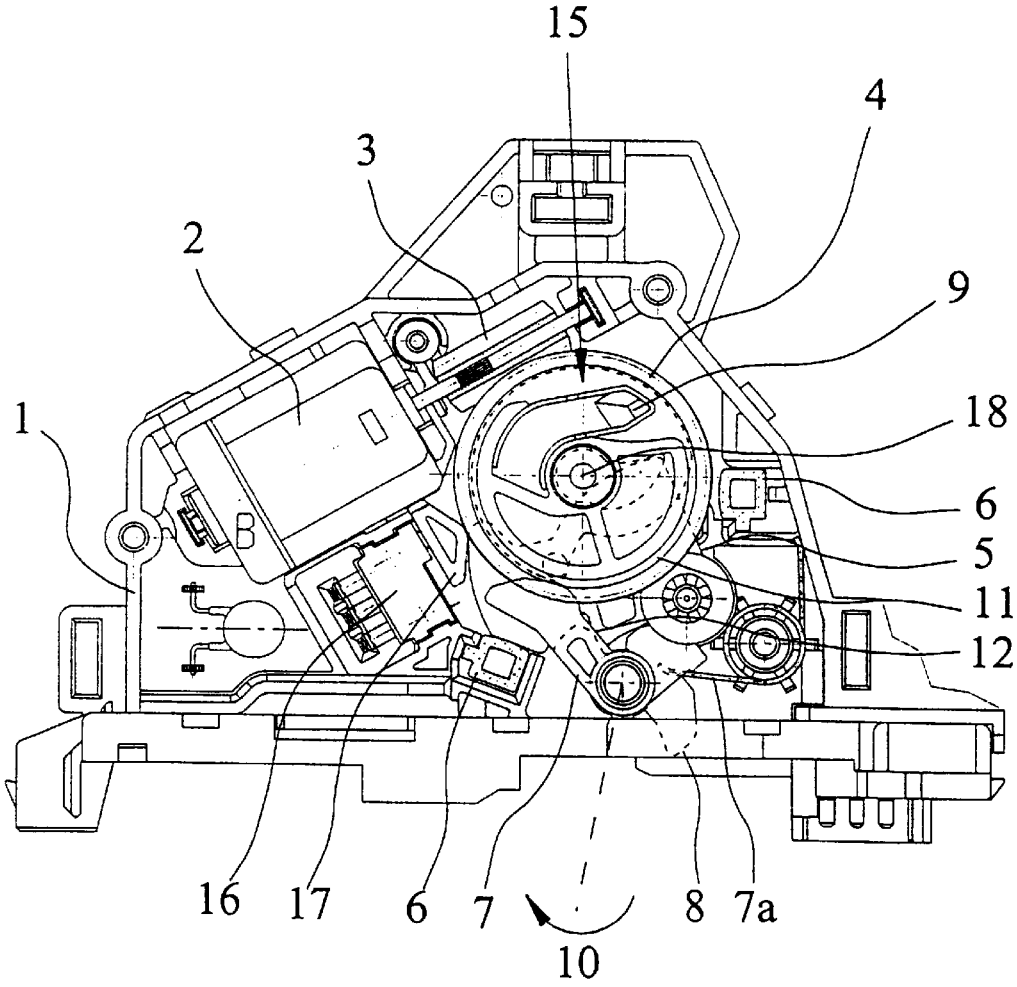
FIG. 2 shows the electric motor actuator of FIG. 1 in the "upper" plane and "unlocked" operating state.

Referring now to the drawings, FIGS. 1 and 2 show in conjunction the basic structure of the preferred embodiment of the electric motor actuator for a motor vehicle lock constructed for operation in "unlocked", "locked" and "locked-antitheft" operating states. Accordingly, the actuating lever system of the motor vehicle lock can be switched into these operating states by means of the electric motor actuator as well as mechanically/manually, and especially by means of an emergency actuation function.

As illustrated in FIG. 1 and 2, an electric motor actuator for a motor vehicle lock including a housing 1 which is opened on one side. The housing 1 first accommodates a reversible drive motor 2 and an actuator disk 4 which can be rotationally driven in this embodiment by the drive motor 2 via a spindle 3. Preferably, the actuator element is a rotationally drivable actuator disk 4 , however, a linearly moved actuator element would also be conceivable. The interaction of the actuator disk 4 with the locking lever system is important. An operating lever 5 is dynamically coupled to the actuator disk 4 for switching the lock mechanism, therefore the locking lever system, into a "unlocked" and "locked" operating state. The operating lever 5 is normally loaded with a tilt spring or the like (not shown) so that it always assumes a positively defined position.

As illustrated in FIG. 1, the operating lever 5 is in the "unlocked" operating state with one side adjoining a buffer 6. The operating lever 5, at least in the end position of the actuator disk 4, can be switched manually back and forth between the "unlocked" and "locked" operating states so that, in cases when the electric motor drive fails, manual unlocking and locking of the motor vehicle lock are possible. FIG. 2 shows a pivotally mounted antitheft lever 7 or the like which is dynamically coupled to the actuator disk 4 or the like. The antitheft lever 7 is loaded by a pretensioning spring 7*a* and is shown in FIG. 2 in the "antitheft off" operating state because, there, the actuator is in the "unlocked" operating state overall. The direction of action of the pretensioning spring 7*a* is shown by the curved arrow.

Figure 3:
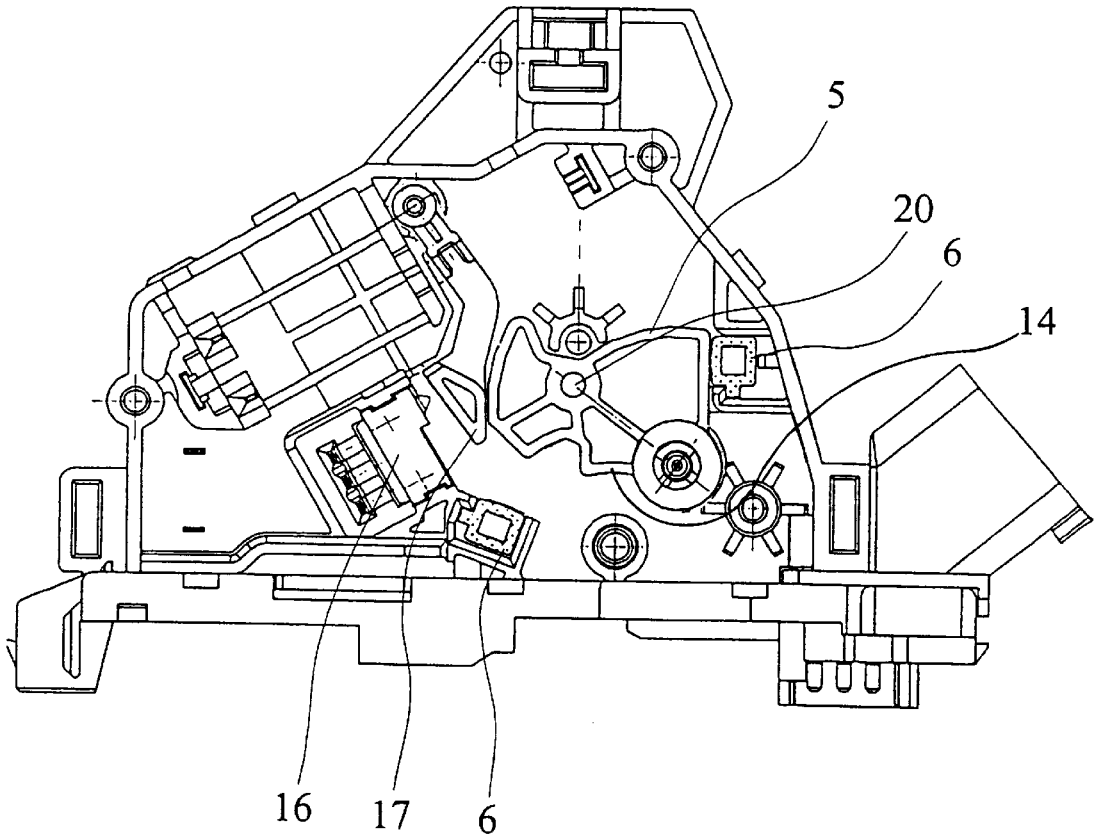
FIG. 3 shows an electric motor actuator for a motor vehicle lock in the "lower" plane and "locked" operating state
Figure 4:
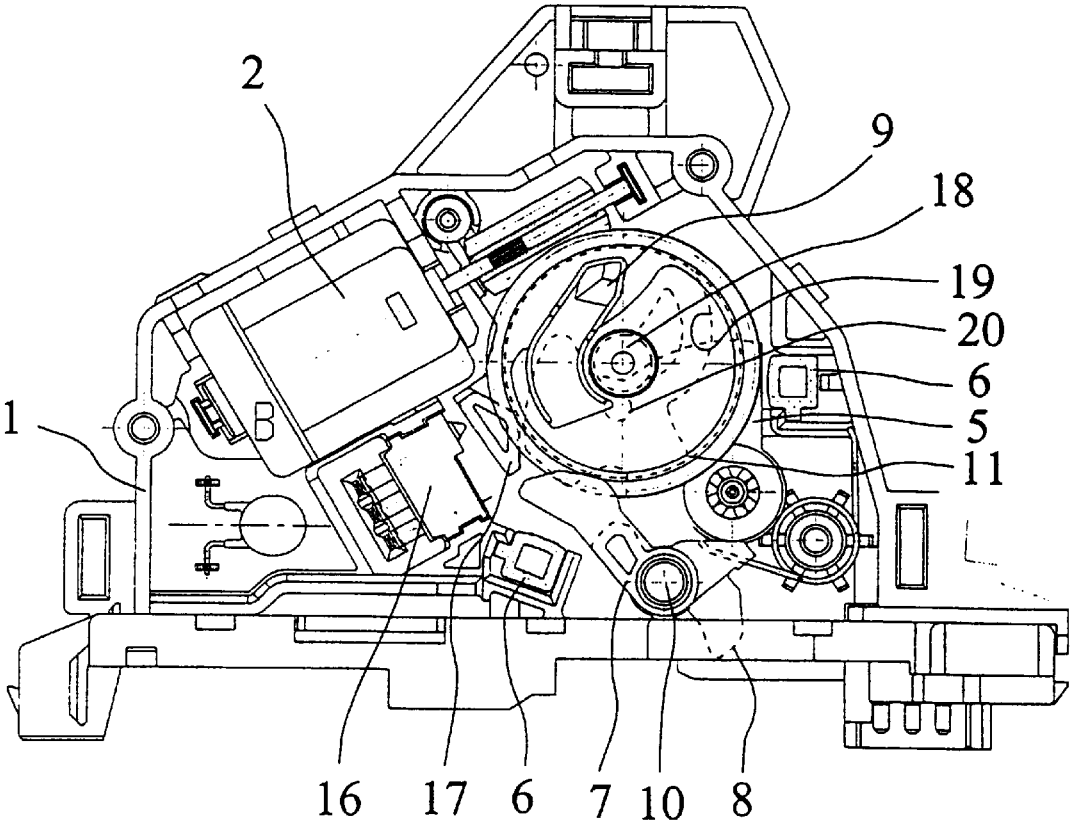
FIG. 4 shows the electric motor actuator in the "upper" plane and "locked" operating state.
Figure 5:
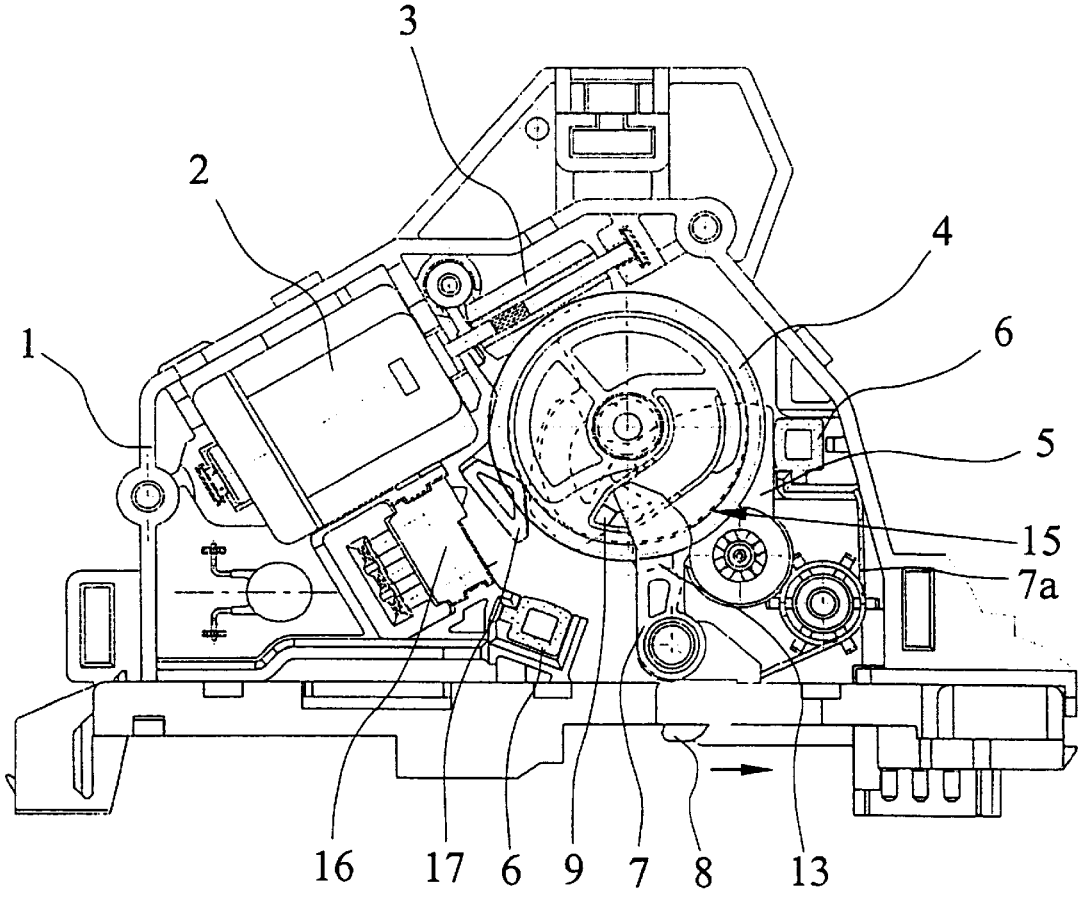
FIG. 5 shows the actuator of FIG. 2 in the "locked-antitheft" operating state.
Figure 6:
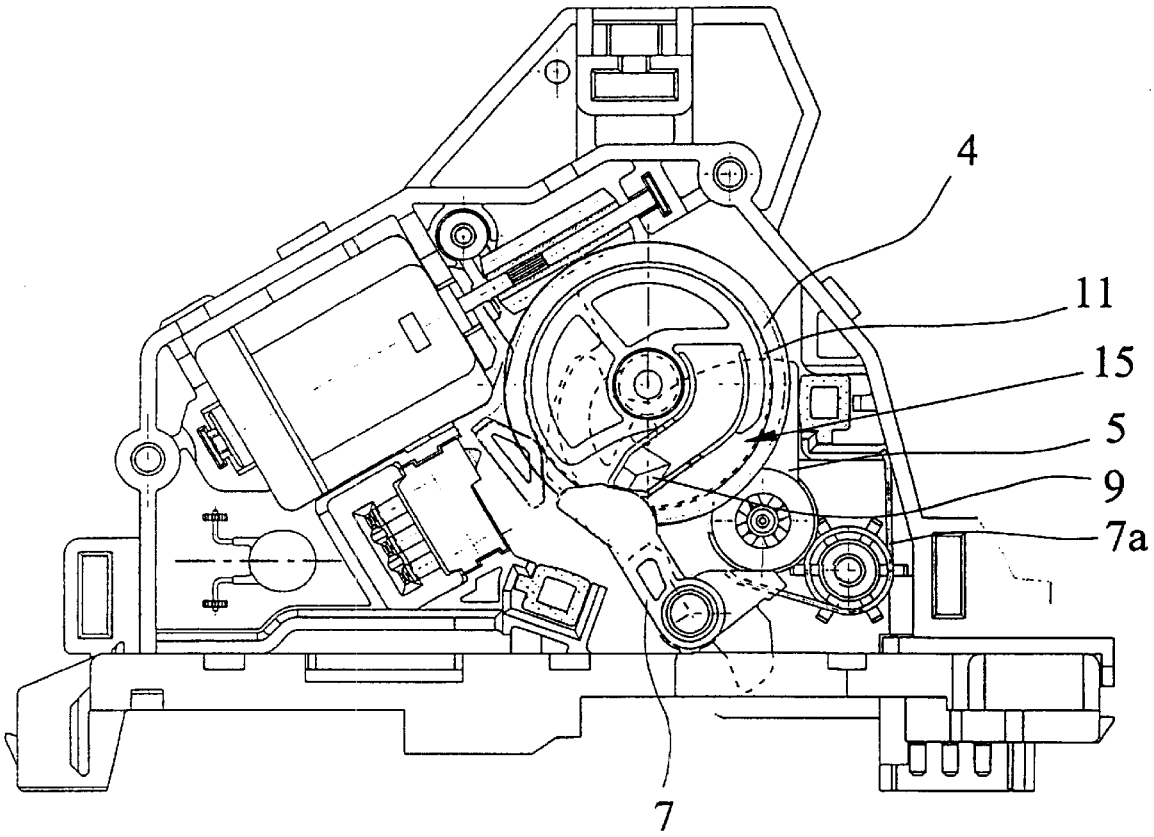
FIG. 6 shows the actuator of FIG. 2 in the "locked-antitheft" operating state, the antitheft lever moved mechanically-manually into the "antitheft-off" operating state.

FIGS. 3 and 4 show the device in the "locked" operating state. FIG. 5 shows the "antitheft" operating state of the antitheft lever 7, whereby the antitheft lever 7 holds the operating lever 5, which is in the "locked" operating state, in its "locked" operating state. On the antitheft lever 7 shown in FIGS. 2, 4 and 5, there is an actuating projection 8 which can be engaged by a mechanical emergency actuating element, especially a key-actuated outer locking lever of the locking lever system, when the motor vehicle lock is assembled. (direction of the arrow in FIG. 5). By way of the emergency actuation element, the antitheft lever 7 can be moved into the "antitheft off" operating state mechanically/manually as the catch 9 or the like is overcome when the actuator disk 4 or the like continues unchanged in the "locked-antitheft" operating state (see FIG. 6).

In spite of integration of an antitheft feature, the actuator in accordance to the present invention can ensure unambiguous assignment of the direction of rotation of the actuator disk 4 or the like to a "unlocked" or "locked" operating state. In this way, control of the electric motor actuator is simple because changing assignments need not be considered by electronics or circuitry. Accordingly, for the actuator in accordance with the invention, there are many fewer switches and sensors than in the prior art which forms the starting point.

It is important that the antitheft lever 7 be switched by means of the pretensioning springs 7*a* or the like from the operating state "antitheft off" (FIGS. 2 and 4) into the "antitheft" operating state (FIG. 5). This means that the antitheft lever 7 is pretensioned from the position shown in FIG. 2 by the pretensioning spring 7*a* with respect to rotation clockwise around a bearing axis 10. FIGS. 2 and 4 further show that the antitheft lever 7 is held by a control crank 11 on the actuator disk 4 or the like in the "antitheft off" operating state. Moreover, the antitheft lever 7 is also held in the "antitheft off" operating state by the operating lever 5 which is in the "unlocked" operating state. FIGS. 1 and 2 show that a corresponding projection 12 on the operating lever 5 in the position of the operating lever 5 prevents the antitheft lever 7 from turning clockwise under spring force from the position shown in FIG. 2. Consequently, if the operating lever 5 is in the "unlocked" operating state, it is independent of the position of the actuator disk 4 or the like such that the antitheft lever 7 is held in the "antitheft off" operating state.

The structure of the electric motor actuator in accordance with the invention provides many advantages over conventional actuators. While the electric motor actuator is constructed very simply due to the operating lever 5 and the antitheft lever 7 being locked relative to one another, it is ensured by the direction of action of the pretensioning spring 7*a* for the antitheft lever 7 that, when the spring breaks, the antitheft lever 7 can continue to move into the "antitheft off" operating state. For reliable operation of the electric motor actuator, it is important that the antitheft lever 7, after mechanical/manual locking from the "antitheft" operating state into the "antitheft off" operating state, is held in this "antitheft off" operating state by the catch 9 or the like. It is therefore important that when the electric motor drive has failed and the operating state "locked-antitheft" has been canceled by engagement of the emergency actuation lever, this cancellation lasts as long as the actuator disk 4 or the like remains in the failure position. It is then desirable that the motor vehicle lock can be switched back and forth at any time mechanically between the "unlocked" and "locked" operating states.

The catch 9 or the like is made as an elastic projection which is beveled on one side. In doing so, this is made as the spring tongue which is formed in the actuator drive 4 or the like. The transition from FIGS. 5 and 6 of the drawings shows how, through mechanical engagement of the actuating projection 8 of the antitheft lever 7 by way of the emergency actuation element (not shown), especially the key-actuated outer locking lever in the direction of the arrow (FIG. 5), the antitheft lever 7 with the catch 9 pressed back elastically has been moved from the "antitheft" operating state back into the "antitheft off" operating state. The actuator drive 4 or the like is, as before, in the position which corresponds to the "antitheft" operating state of the antitheft lever 7. At this point, the action of the catch 9 or the like holds the antitheft lever 7 against the force of the pretensioning spring 7*a* in the "antitheft off" operating state in FIG. 6. The operating lever 5 can be freely moved since the antitheft lever 7 does not block the operating lever 5 in the "locked" operating state. Conversely, FIG. 5 shows the "locked-antitheft" operating state. In this operating state the antitheft lever 7 with a stop 13 which in front of the edge 14 of the operating lever 5 in its position shown in FIG. 3, blocks the motion of the operating lever 5 into the "unlocked" operating state, therefore back to the position in FIG. 1.

The preferred embodiment illustrates an especially feasible and compact construction of the electric motor actuator wherein the actuator disk 4 or the like is made in three planes, specifically a middle plane for coupling to the electric drive motor 2 via the spindle 3, a lower plane for coupling to the operating lever 5, and an upper plane for coupling to the antitheft lever 7. The terms "lower" and "upper" are, as mentioned, interchangeable. They are, therefore, chosen in the embodiment shown for this reason in this way because the "lower" plane shown in FIGS. 1 and 3 is closest to the bottom of the housing 1, while the "upper" plane shown in FIGS. 2 and 4–6 are away from the bottom of the housing 1. Moreover, a simple configuration of the control crank 11 is provided and is made simply as a raised edge on the actuator disk 4 or the like. The actuator disk 4 has an opening 15 where the antitheft lever 7 under the action of the pretensioning spring 7*a* can be swivelled into the inner area of the actuator disk 4 or the like and reach the "antitheft" operating state as shown in FIG. 5. In this operating state, the antitheft lever 7 is then behind the projection of the catch 9 which however, as already mentioned above, can be "moved over" within the framework of emergency actuation. It has already been pointed out above that the antitheft lever 7 is made as a two-arm lever with the actuating projection 8 on the second lever arm.

In the preferred embodiment, the actuator disk 4 or the like and the antitheft lever 7 are preferably composed of a plastic material. The forces which occur are dimensioned in this construction such that the use of plastic material, optionally also fiber-reinforced, is quite sufficient when the corresponding material thicknesses are provided. Of course, in principle, other materials can be used, especially metals such as aluminum. For the operating lever 5, which is more highly loaded by force, a metal, for example, aluminum, is recommended as the material.

FIG. 2 further illustrates a microswitch 16 which is assigned to the operating lever 5. The microswitch 16 allows starting of the "locked" operating state which is correct in terms of control engineering. After actuating the microswitch 16, the electric drive motor 2 is stopped at a short angular distance by means of plug braking or the like. The microswitch 16 can be actuated via a switch actuating lever 17 to allow suitable force transmission from the operating lever 5 to the microswitch 16. FIGS. 1 and 3 show an arrangement and operation of the microswitch 16 with a switch actuating lever 17. In FIG. 1, the microswitch 16 is actuated in an "unlocked" operating state, while in FIG. 3 the microswitch 16 is not actuated in a "locked" operating state. The switch actuating lever 17 is moved in the manner shown by the operating lever 5.

In the representation of the planes, the switch actuating lever 17 lies in the same plane with the operating lever 5. The switch actuating lever 17 is preferably made of plastic because the switch actuating lever 17 is not exposed to overly high force loads. It is not recognizable in the drawings because the configuration of the arrangement is hidden in the lower plane such that the microswitch 16, via the switch actuating lever 17, can be actuated not only by the operating lever 5, but also by an actuating element on the actuator disk 4 or the like, especially via a crank which is located in the shape of a sector in the lower plane on the actuator disk 4. The drawings further illustrate the switch actuating lever 17 on one end has the actual lever arm, while on the other end includes a projecting actuating button which fits into the middle plane.

With the actuation of the microswitch 16 via the switch actuating lever 17, both by the operating lever 5 and also by the actuator disk 4 or the like, an OR gate or an AND gate can be easily mechanically accomplished. The circuitry particularity which leads to the fact that, in the prior art, the required two microswitches can be replaced by one microswitch with the same control engineering performance shown in the prior art. The actuator disk 4 transfers its motion to the operating lever 5 in the desired manner as follows. The actuator disk 4 has a control crank 19 which extends in a curve-like manner around the axis 18 of rotation of the actuator disk 4 and which has, on one end, an inner stop near the axis 18 of rotation and on the opposing end an outer stop away from the axis 18 of rotation. The operating lever 5 has a journal 20 which fits into the control crank 19 of the actuator disk 4 on the operating lever 5. Via the latter, the operating lever 5 can be switched into the "unlocked" and "locked" operating states which are achieved when the inner stop or the outer stop of the control crank 19 engages the journal 20 or the like. In this case, shut-off of the electric drive motor 2 is triggered or initiated when at least one of the inner stop and the outer stop engages the journal 20 or the like (block operation).

While the present invention has been described in connection with what is considered to be the most practical embodiment, it is understood that this invention is not limited to the disclosed embodiments and may reasonable encompass various arrangements included with in the spirit and scope of the broadest interpretations and equivalent arrangements.

I claim:

1. An electric motor actuator for a motor vehicle lock that can be switched into an "unlocked", "locked" and "locked-antitheft" operating state, said electric motor actuator comprising:

a reversible drive motor;

an actuator drive driven by said reversible drive motor and having two end positions;

an operating lever dynamically coupled to said actuator drive for switching said motor vehicle door lock into said "unlocked" and "locked" operating states, wherein said operating lever, at least in one end position of said actuator drive, is free to be mechanically switched between said "unlocked" and "locked" operating states;

an antitheft lever dynamically coupled to said actuator drive for maintaining said operating lever in said "locked" operating state, said antitheft lever having the operating states "antitheft" and "antitheft-off," the operating state "antitheft" of the antitheft lever together with the operating state "locked" of the operating lever defining the operating state "locked-antitheft" of the actuator, said antitheft lever being spring-loaded towards the "antitheft" operating state by a pretensioning mechanism, wherein said pretensioning mechanism is adapted to switch said antitheft lever from said "antitheft-off" operating state into said "antitheft" operating state, wherein said antitheft lever is maintained in the "antitheft-off" operating state against the force of the pretensioning mechanism on the one hand by a control crank mounted on said actuator drive and on the other hand by the operating lever in its "unlocked" operating state;

a catch mechanism mounted on said actuator drive, said catch mechanism being positioned proximal to the antitheft lever in its "antitheft" operating state while said actuator drive is in said "locked" operating state and holding said antitheft lever in its "antitheft" operating state; and an emergency actuating mechanism for mechanically moving said antitheft lever from its "antitheft" operating state into its "antitheft-off" operating state overcoming the catch mechanism while said actuator drive is in said "locked" operating state, wherein said catch mechanism then mechanically holds the antitheft lever in the "antitheft-off" operating state against the force of the pretensioning mechanism.

2. The electric motor actuator as claimed in claim 1, wherein said emergency actuating mechanism is a key-actuated outer locking lever for engaging an actuating projection on said antitheft lever.

3. The electric motor actuator as claimed in claim 1, wherein said catch mechanism is a beveled elastic projection.

4. The electric motor actuator as claimed in claim 1, wherein said catch mechanism is an elastic tongue which is formed on said actuator drive.

5. The electric motor actuator as claimed in claim 3, wherein said catch mechanism is an elastic tongue which is formed on said actuator drive.

6. The electric motor actuator as claimed in claim 1, wherein said actuator drive is constructed into three planes, said actuator drive being coupled to said reversible drive motor in a middle plane, said actuator drive being coupled to said operating lever in one of upper and lower planes relative to a housing of the actuator, and said actuator drive being coupled to said antitheft lever in the other of said upper and lower planes.

7. The electric motor actuator as claimed in claim 1, wherein said control crank on said actuator drive includes a raised edge with an opening; said antitheft lever moving from the "antitheft-off" operating state into said "antitheft" operating state by means of said pretensioning means through said opening in the raised edge.

8. The electric motor actuator as claimed in claim 1, wherein said antitheft lever is a two-armed lever.

9. The electric motor actuator as claimed in claim 1, wherein said actuator drive and said antitheft lever are composed of a plastic material.

10. The electric motor actuator as claimed in claim 1, further comprising a microswitch assigned to said operating lever, said microswitch being positioned for actuation by said operating lever via a switch actuating lever.

11. The electric motor actuator as claimed in claim 10, wherein said switch actuating lever is composed of a plastic material.

12. The electric motor actuator as claimed in claim 10, wherein said microswitch is positioned for actuation by at least one of said operating lever and an actuating element on said actuator drive.

13. The electric motor actuator as claimed in claim 1, wherein said actuator drive includes a control groove extending in a curve around an axis of rotation of said actuator drive.

14. The electric motor actuator as claimed in claim 13, wherein said second control groove includes a first end having an inner stop located substantially proximal to the axis of rotation of said actuator drive, and a second end opposing said first end and having an outer stop distal from the axis of rotation of said actuator drive.

15. The electric motor actuator as claimed in claim 14, wherein said operating lever includes a journal which fits said control groove and is positioned for being moved by said control groove into one of said "locked" and "unlocked" operating states when said inner stop engages said journal and into the other of said "locked" and "unlocked" operating states when said outer stop engages said journal.

16. The electric motor actuator as claimed in claim 15, wherein said operating lever is manually switchable between said "locked" and "unlocked" operating states when said journal is engaged by at least one of said inner stop and said outer stop in a free running state.

17. The electric motor actuator as claimed in claim 16, wherein shut-off of said reversible drive motor is initiated when at least one of said inner stop and said outer stop engages said journal.

* * * * *